US008251257B2

(12) United States Patent
Oberhofer et al.

(10) Patent No.: US 8,251,257 B2
(45) Date of Patent: Aug. 28, 2012

(54) VESSEL HAVING $CO_2$ COMPRESSED GAS SOURCE

(75) Inventors: Kurt Oberhofer, Wilhelmsfeld (DE); Timm Oberhofer, Wilhelmsfeld (DE)

(73) Assignee: Huber Packaging Group GmbH, Oehringen (DE)

( * ) Notice: Subject to any disclaimer, the term of this patent is extended or adjusted under 35 U.S.C. 154(b) by 774 days.

(21) Appl. No.: 11/921,539

(22) PCT Filed: May 27, 2006

(86) PCT No.: PCT/EP2006/005090

§ 371 (c)(1),
(2), (4) Date: Dec. 15, 2008

(87) PCT Pub. No.: WO2006/128654

PCT Pub. Date: Dec. 7, 2006

(65) Prior Publication Data

US 2009/0090741 A1 Apr. 9, 2009

(30) Foreign Application Priority Data

Jun. 2, 2005 (EP) ..... 05011896
Sep. 27, 2005 (EP) ..... 05020984

(51) Int. Cl.
*B67D 5/00* (2006.01)

(52) U.S. Cl. ..... 222/5; 222/81; 222/399; 220/361; 220/601

(58) Field of Classification Search ..... 222/5, 81–83.5, 222/88, 89, 396, 397, 373, 399, 394, 3; 220/361, 220/601; 141/19; 137/209–212
See application file for complete search history.

(56) References Cited

U.S. PATENT DOCUMENTS

| | | | | | |
|---|---|---|---|---|---|
| 3,789,861 | A * | 2/1974 | Conn et al. | 134/166 C |
| 4,189,068 | A * | 2/1980 | Apellaniz | 222/83.5 |
| 4,456,155 | A * | 6/1984 | Miyata et al. | 222/396 |
| 4,632,276 | A * | 12/1986 | Makino | 222/80 |
| 4,735,348 | A * | 4/1988 | Santoiemmo et al. | 222/399 |
| 5,110,012 | A * | 5/1992 | Scholle et al. | 222/83.5 |
| 5,176,298 | A * | 1/1993 | Mogler et al. | 222/400.7 |
| 5,894,869 | A * | 4/1999 | Mussack | 141/19 |
| 5,979,713 | A * | 11/1999 | Grill | 222/399 |
| 6,386,403 | B2 * | 5/2002 | Parsons et al. | 222/399 |
| 7,845,522 | B2 * | 12/2010 | Grill | 222/399 |

* cited by examiner

*Primary Examiner* — Kevin P Shaver
*Assistant Examiner* — Donnell Long
(74) *Attorney, Agent, or Firm* — Galgano & Associates, PLLC; Thomas M. Galgano; Jessica G. Bower

(57) ABSTRACT

The compressed $CO_2$ gas source is an insert that can be fixed in a sealed manner in an opening of the vessel. The insert has a high-pressure $CO_2$ cartridge, a pressure-regulating valve for discharging $CO_2$ therefrom and a control element that is accessible from the outside and that can be actuated to pierce the high-pressure $CO_2$ cartridge. The control element can be automatically interlocked and blocked against further actuation after it has first been actuated.

17 Claims, 2 Drawing Sheets

VESSEL HAVING $CO_2$ COMPRESSED GAS SOURCE

BACKGROUND OF THE INVENTION

1. Field of the Invention

The invention relates to a vessel that can be filled with liquid and closed in pressure-tight condition, and from which liquid can be withdrawn. Examples of such vessels are drums, small drums (party kegs) or cans, in which $CO_2$-containing liquids, especially beverages, are filled under pressure. In particular, it relates to party beer kegs.

2. Description of Related Art

There exist tap fittings that operate with high-pressure $CO_2$ cartridges and that can be used to tap such vessels in order to withdraw liquid therefrom by means of $CO_2$ pressure. This corresponds to the standard tapping technique in gastronomy, wherein $CO_2$ from high-pressure $CO_2$ bottles is used and very good wholesomeness and shelf life of the beer are achieved.

In some consumer groups, however, tap fittings with $CO_2$ high-pressure cartridges have not become popular. For persons who buy party beer kegs only occasionally, it is not worthwhile to procure an expensive tap fitting. Some people are even uncomfortable handling high-pressure $CO_2$ cartridges. Others worry about the replacement supply of cartridges.

There have therefore been developed party beer kegs equipped with an integrated outlet tap in the bottom region of the keg, whereby the beer can be drawn by the internal pressure and gravity alone. Usually air is admitted to the party keg above the liquid surface therein, in order to permit pressure equalization. This can be achieved by puncturing with a can opener. However, other party beer kegs have an integrated outlet tap and a hand-operated air-admission valve in the top end plate of the keg, forming part of a bunghole closure (see WO 99/23008 A1).

A disadvantage of such party kegs is that the wholesomeness and shelf life of the beer are impaired by the ingress of air into the top space of the keg. When a party keg of this type is tapped, the contents must be consumed quickly, so that the beer does not become flat and stale.

Several suggestions have been made as regards improving the shelf life of beer in a tapped party keg. For example, WO 99/47451 A1 teaches integrating an aerosol can that contains $CO_2$ bound to active carbon under low pressure into the party keg and building up a $CO_2$ pressure in the top space of the keg sufficient to equal or exceed the partial pressure of the $CO_2$ dissolved in the beer. A disadvantage is the large volume of the can. Furthermore, active carbon is a very expensive storage medium.

From DE 19952379 A1 there is known a $CO_2$ dispenser for party kegs in the form of a separate manual device, with which the party keg is pierced above the liquid surface therein in order to pump $CO_2$ into the top space of the keg. The dispenser contains a high-pressure $CO_2$ cartridge and a pressure-regulating valve. It is intended for multiple uses and can be transferred from party keg to party keg. Even if the $CO_2$ consumption may be smaller than in the case of a tap fitting operating with $CO_2$, such a $CO_2$ dispenser ultimately raises similar concerns in consumer groups.

From practice it is also known that there can be introduced into the top space of a party beer keg a pressure bag, which expands when the pressure in the top space drops, thereby on the one hand filling the empty space being formed and on the other hand exerting a contact pressure on the liquid surface in the keg greater than the partial pressure of the $CO_2$ dissolved in the beer. The pressure bag comprises multiple plies of plastic film that is impermeable to oxygen diffusion. It has a plurality of chambers that contain gas-forming chemicals, such as baking powder and citric acid. The chambers are successively activated as the pressure drops in the top space of the party keg and are inflated by the gas evolved during the reaction of the chemicals.

A disadvantage of the known pressure bag is the unsteady application of pressure on the beer. The pressure rises suddenly when the respective next chamber of the pressure bag is activated, and it then drops successively. This results in irregular tap behavior. The tap behavior fluctuates between discharge of the beer in a strong stream and a mere trickle.

The starting point of European Patent Application No. 05011896.7 is to provide a vessel of the type mentioned hereinabove having an integrated compressed $CO_2$ gas source of small overall volume, from which discharged $CO_2$ exerts a steady pressure on the liquid in the vessel and improves its shelf life and wholesomeness. The vessel has an insert that can be fixed in sealed manner in an opening of the vessel and a high-pressure $CO_2$ cartridge, a pressure-regulating valve for discharging $CO_2$ therefrom and a control element that is accessible from the outside and that can be actuated to pierce the high-pressure $CO_2$ cartridge with a piercing needle.

By virtue of its small overall volume, the insert is suitable for replacing the bunghole closure with pressure-equalizing valve according to WO 99/23008 A1, without necessitating any substantial modifications to the shape and size of the respective vessel to be equipped therewith, such as a party beer keg. The processes at a filling plant are altered slightly at most. The insert can be made of plastic materials, which for years have proved most suitable for a bunghole closure with pressure-equalizing valve and an outlet tap. The operation of the compressed $CO_2$ gas source can be designed such that a user familiar with actuation of a conventional pressure-equalizing valve hardly notices any difference. The user does not directly handle a high-pressure $CO_2$ cartridge, which would probably make him uncomfortable. The cartridge is designed for one-time use in a single vessel and will be disposed of together therewith. In particular, the shelf life of beer in a tapped party keg will be extended by several days without concern by filling the top space with $CO_2$ instead of air.

Commercial pierceable $CO_2$ cartridges in a size suitable for the compressed $CO_2$ gas source contain approximately 16 g of $CO_2$ at a pressure of approximately 80 bar. The reduction and precise regulation of the pressure of the $CO_2$ discharged into the top space of the vessel imposes considerable requirements on the construction of a compressed $CO_2$ gas source in the form of a compact insert. The pressure is typically between 0.5 and 0.9 bar. It is equal to or slightly higher than the partial pressure of the $CO_2$ dissolved in the liquid.

Especially for beer, the $CO_2$ content is one of the factors that determines the taste. The $CO_2$ content varies from beer variety to beer variety. If the $CO_2$ pressure in the top space of the party keg is too low, $CO_2$ escapes from the beer. If the $CO_2$ pressure in the top space is too high, the beer becomes overcarbonated and its taste and wholesomeness are impaired. The compressed $CO_2$ gas source described in European Patent Application No. 05011896.7 ensures that neither one nor the other occurs.

In the vessel according to European Patent Application No. 05011896.7, the control element actuated to pierce the high-pressure $CO_2$ cartridge is a rotary knob, which cooperates with an axially guided slide used to actuate a piercing needle. The piercing needle is structurally combined with a valve element of the pressure-regulating valve. Its regulating function may be adversely affected if the user actuates the rotary knob once again. Certainly this is completely undesirable, but in the vessel according to European Patent Application No. 05011896.7 it is not precluded.

BRIEF SUMMARY OF THE INVENTION

The object of the invention is to secure the vessel known from European Patent Application No. 05011896.7 against manipulations of the control element of the insert, so that the regulating function of the pressure-regulating valve cannot be affected.

This object is achieved in that the control element of the insert can be automatically interlocked and blocked against further actuation after it has first been actuated.

In a preferred embodiment, the control element is a rotary knob that cooperates with an axially guided slide, which can be used to actuate a piercing needle for piercing the high-pressure $CO_2$ cartridge. The rotary knob is blocked by the slide.

In a preferred embodiment, the rotary knob is screwed forward against the slide, so that the slide is axially adjusted by turning the rotary knob. The piercing needle is driven axially by the slide. After a predetermined angle of rotation has been exceeded for piercing the high-pressure $CO_2$ cartridge, the slide springs back axially against the rotary knob. The slide snaps into the rotary knob and blocks it against further actuation.

In a preferred embodiment, the piercing needle is structurally combined with a valve member of the pressure-regulating valve, which is axially adjustable between a sealing position and a passing position at a valve seat of the pressure-regulating valve. The slide springs back when actuated by the piercing needle.

In a preferred embodiment, the slide comes into flush contact with the piercing needle during piercing of the high-pressure $CO_2$ cartridge, such that end face is against end face.

In a preferred embodiment, the piercing needle occupies a sealing position directly downstream from the valve seat of the pressure-regulating valve just before piercing takes place. Thereby the volume of the valve space to which the maximum pressure of the high-pressure $CO_2$ cartridge is admitted after it has been pierced is very small.

In a preferred embodiment, the vessel has a tightly sealed chamber, in which the head of the high-pressure $CO_2$ cartridge has a snug fit at the opening of the vessel. The tight seal of the chamber is preferred for hygiene reasons.

In a preferred embodiment, the high-pressure $CO_2$ cartridge is sealed against the wall of the chamber, around the circumference of its small diameter neck. Thereby the axial forces to which the cartridge is subjected during piercing are limited.

In a preferred embodiment, the insert occupies a top opening of the vessel. The $CO_2$ from the high-pressure $CO_2$ cartridge can be discharged not only into a top space of the vessel above the liquid surface therein, but also via a non-return valve directly into the liquid.

In a preferred embodiment, the opening that receives the insert is a bunghole, through which the vessel is filled with liquid. The insert functions as the bunghole closure.

The $CO_2$ from the high-pressure $CO_2$ cartridge can be discharged into the top space of the vessel above the liquid surface therein. However, it is also possible to connect a pressure bag to the insert. The pressure bag is pulled on by applying vacuum to the housing of the insert and is tightly heat-sealed to the housing. The pressure bag is ultimately disposed in direct contact with the housing of the insert in the interior of the vessel. It is inflated by the discharged $CO_2$. Compared with the prior art pressure bag mentioned herein-above, the advantage is then achieved that the filling pressure of the pressure bag is constant, or in other words no pressure fluctuations and irregularities in tapping behavior occur. The filling pressure can be set at a somewhat higher value than the partial pressure of the $CO_2$ dissolved in the liquid, which pressure therefore remains completely unaffected and neutral as regards taste.

In the variant with the pressure bag, a compressed gas other than $CO_2$ may also be injected from a high-pressure cartridge.

In a preferred embodiment, the vessel has an outlet tap at the bottom. Withdrawal of the liquid then takes place by internal pressure and the effect of gravity. The $CO_2$ from the high-pressure $CO_2$ cartridge prevents a reduced pressure from developing in the top space of the vessel. This is possible in the variants with and without pressure bag.

In the variant with the pressure bag, the vessel can have, instead of the outlet tap, a top spigot to which there leads a riser line extending to the bottom of the vessel. The liquid is conveyed by the pressure of the $CO_2$ discharged from the high-pressure $CO_2$ cartridge to the spigot. Tapping at the top of the vessel is more convenient than at the bottom.

In a preferred embodiment, an outlet spout together with a hose connection is provided on the outside of the spigot. The outlet spout is added to the vessel as a separate part. It is clipped onto the said vessel after the spigot has been removed.

BRIEF DESCRIPTION OF THE DRAWINGS

The invention will be explained in more detail hereinafter on the basis of an exemplary embodiment illustrated in the drawings.

DETAILED DESCRIPTION OF THE INVENTION

Figure 1:
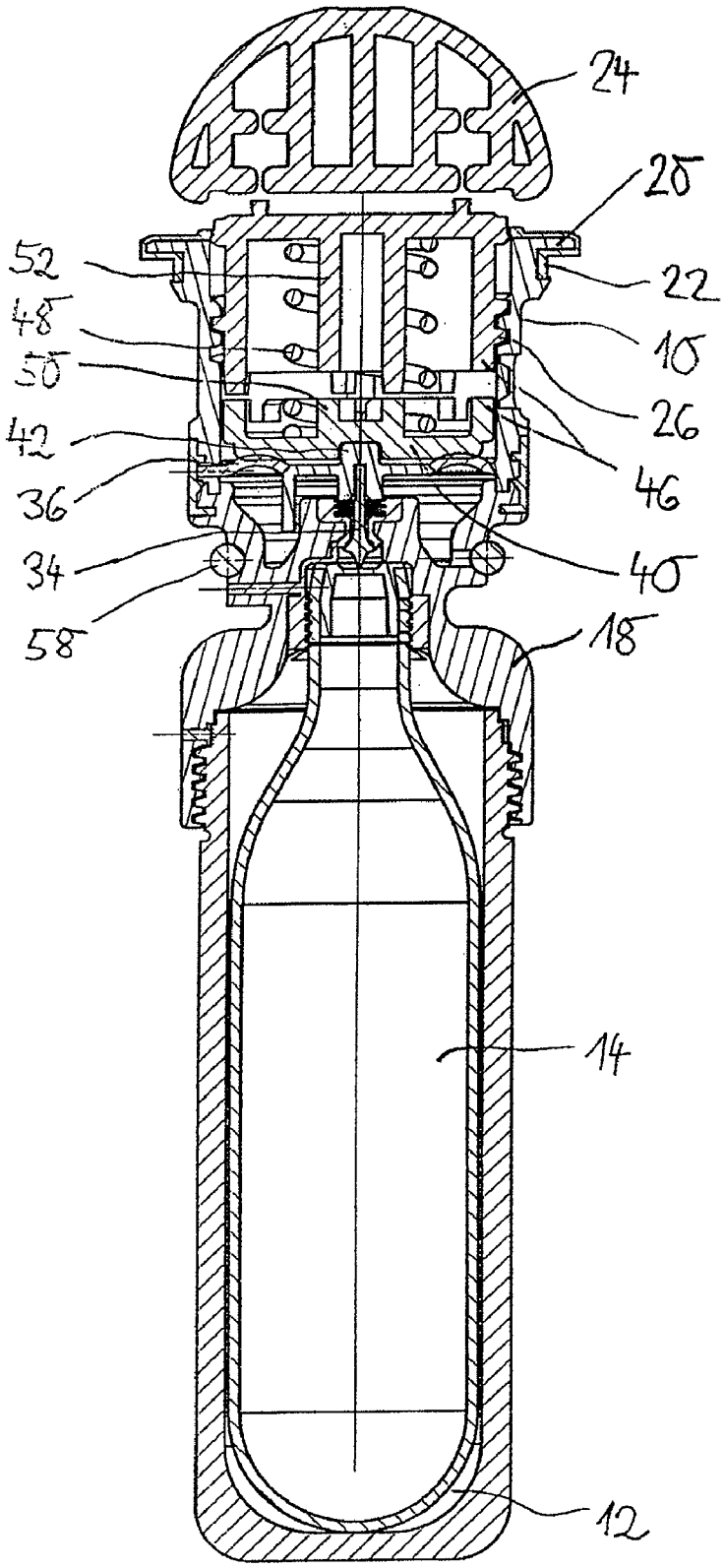
FIG. 1 shows a compressed $CO_2$ gas source in longitudinal section.

The compressed $CO_2$ gas source is constructed as an insert, which fits in the bunghole of a vessel, extends into the vessel and tightly closes the bunghole. The compressed $CO_2$ gas source can take the place of the bunghole closure with pressure-equalizing valve according to WO 99/23008 A1.

The vessel is filled under pressure with $CO_2$-containing liquid through the bunghole usually disposed at the middle of its top end plate. Thereafter the bunghole is tightly closed with the insert. To withdraw the liquid, there can be used an integrated outlet tap, which is disposed on the side wall of the vessel at the height of the bottom end plate thereof. The liquid flows out under the action of internal pressure and gravity, until a reduced pressure is reached in the top space of the vessel above the liquid surface therein. To adjust this correctly and maintain it in controlled manner, the compressed $CO_2$ gas source is activated. The compressed $CO_2$ gas source injects $CO_2$ into the top space of the vessel under a pressure that corresponds to the partial pressure of the $CO_2$ dissolved in the liquid or that slightly exceeds this partial pressure. Thereby steady emptying of the vessel is ensured. No air is admitted into the top space of the vessel. The $CO_2$ content of the liquid remains constant.

The insert has slender elongated shape, and for the most part is radially symmetric relative to a central axis. It is made largely of plastic. The plastic materials used for its manufacture have proved effective for years for bunghole closures and outlet taps of relevant vessels. The two-component plastic injection-molding technique can be used for manufacture.

When the insert is in installed condition, closing the bunghole of the vessel, it projects with a housing 10 into the vessel.

At its inside end housing 10 has a chamber 12 for receiving a high-pressure $CO_2$ cartridge 14 in a snug fit. The head of cartridge 14, at the end face of which it can be pierced, is proximal to the bunghole. Cartridge 14 has its smallest diameter at a straight cylindrical neck. Here it is sealed with a circumferential seal against the wall of housing 10.

The inside end of chamber 12 is closed with a cover 18, which is welded or bolted to the wall of housing 10.

Housing 10 is supported externally with a circumferential collar 20 on the beaded rim of the bunghole. On collar 20 there is formed a seal 22, with which the insert seals the bunghole.

A rotary knob 24 countersunk in housing 10 protrudes outwardly beyond collar 20, and can be actuated to pierce $CO_2$ cartridge 14. Rotary knob 24 has a steep male thread 26, with which it is screwed into a complementary female thread of housing 10.

To pierce $CO_2$ cartridge 14 there is used a piercing needle 34, which is structurally combined with the valve member of a pressure-regulating valve 68. The valve member is mounted together with an elastic diaphragm 36 at the center of the axis of housing 10. The tip of piercing needle 34 is disposed only a short distance from the end face of $CO_2$ cartridge 14.

During axial positioning movement of piercing needle 34 on $CO_2$ cartridge 14, the valve member lifts from a valve seat 38 of the pressure-regulating valve 68. The valve seat is made from elastic sealing material and molded onto housing 10.

Piercing needle 34 is urged by a slide 40, which is disposed between rotary knob 24 and piercing needle 34. Slide 40 is guided in longitudinal sliding relationship in housing 10. It is in flush contact with piercing needle 34, such that end face is against end face. Piercing needle 34 is guided with a central centering extension 42 in a close-fitting opening of slide 40.

Rotary knob 24 and slide 40 are in contact with ridges 46 extending in circumferential direction. There are provided two ridges 46, which are disposed opposite one another and which each have a circumferential length of approximately 90°. Between ridges 46 there are disposed gaps, into which ridges 46 of the respective other part fit in the manner of a rectangular toothing. Upon actuation, rotary knob 24 is screwed forward against slide 40, which is axially adjusted in the process.

A helical compression spring 48 is clamped between rotary knob 24 and slide 40. Helical compression spring 48 is disposed around a central, plug-like extension 50 on the outside of slide 40 distal from piercing needle 34 and around a central, axial tappet 52 on the inside of rotary knob 24. Helical compression spring 48 braces slide 40 against piercing needle 34.

Figure 2:
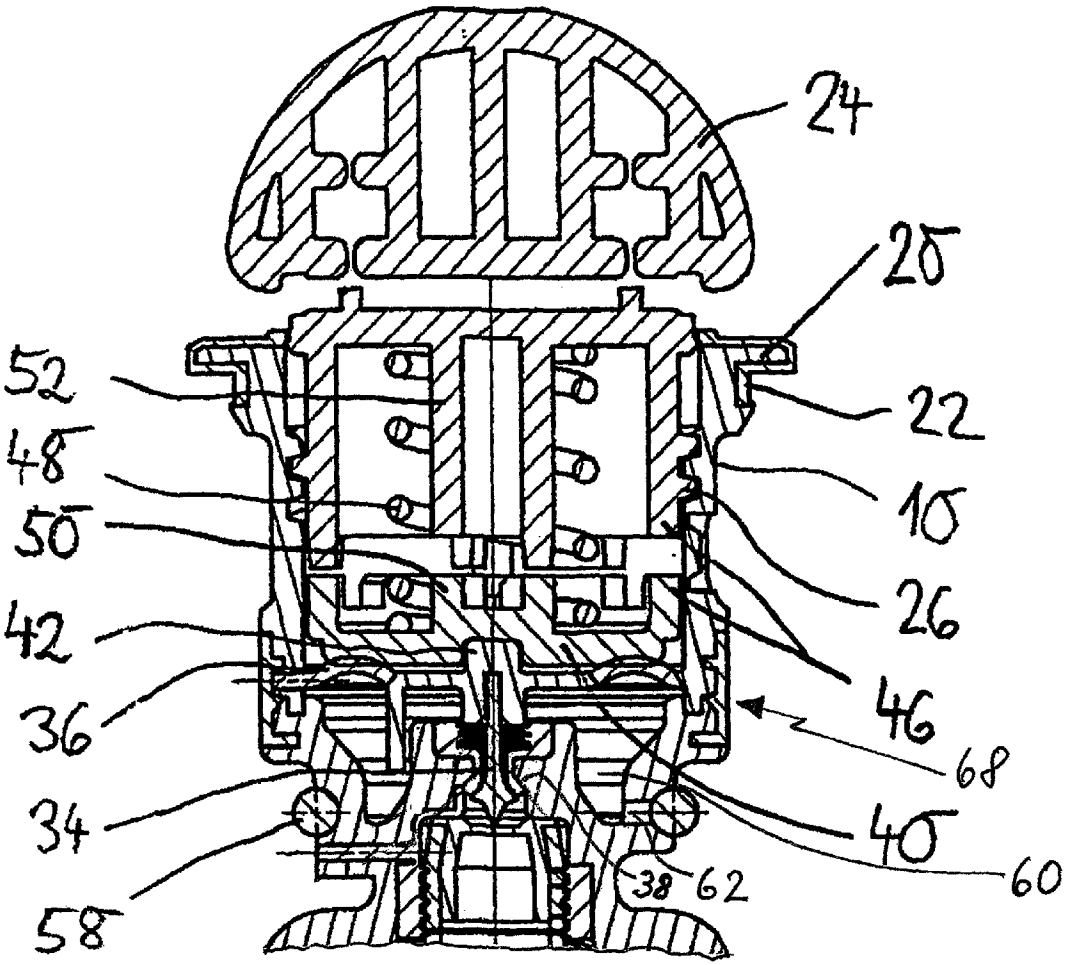
FIG. 2 is an enlarged view of the upper portion of FIG. 1.

As seen in FIG. 2, diaphragm 36 bounds a working space 60 downstream from valve seat 38 of the pressure-regulating valve. The working space 60 has a lateral outlet opening 62, in front of which there is disposed an elastic O-ring 58. O-Ring 58 has the function of a non-return valve. It prevents liquid from entering the insert.

To pierce $CO_2$ cartridge 14, rotary knob 24 is turned by approximately 90°. Slide 40 is moved axially inward by the screwing thrust of rotary knob 24. Piercing needle 34 is driven axially inward under elastic deformation of diaphragm 36. The valve member lifts from the valve seat 38. After piercing, a very small valve space upstream from the head of $CO_2$ cartridge 14 fills with $CO_2$ under high pressure.

After rotary knob 24 has turned a complete 90° or more, slide 40 springs axially back outward under the force of helical compression spring 48. For this purpose it is actuated by piercing needle 34, which is retracted axially by the elastic return deformation of diaphragm 36. Helical compression spring 48 is compressed. The pressure-regulating valve is closed and a small amount of $CO_2$ under high pressure is admitted into the working space 60. The compressive forces of the $CO_2$ on diaphragm, (36) contribute to the spring-back of slide 40 actuated by the piercing needle. Slide 40 snaps with its ridges 46 into the complementary gaps of rotary knob 24, and it blocks rotary knob 24 against further actuation.

Further opening and closing of the pressure-regulating valve is determined by an equilibrium of forces across diaphragm 36, established by the elastic properties of diaphragm 36, the spring constant of helical compression spring 48 and the $CO_2$ pressure in the working space. The determining factor for the pressure of the discharged $CO_2$ is the spring constant of helical compression spring 48.

Usually the user will activate the compressed $CO_2$ gas source when the internal pressure in the vessel has dropped so much that the stream of liquid emerging through the outlet tap is too weak. However, the compressed $CO_2$ gas source can already be activated beforehand without difficulty even if the internal pressure in the vessel is still high. Introduction of $CO_2$ into the top space of the vessel does not take place as long as the high internal pressure is acting on O-ring 58 in front of the outlet opening.

LIST OF REFERENCE NUMERALS

10 Housing
12 Chamber
14 High-pressure $CO_2$ cartridge
18 Cover
20 Collar
22 Seal
24 Rotary knob
26 Male thread
34 Piercing needle
36 Diaphragm
38 Valve seat
40 Slide
42 Centering extension
46 Ridge
48 Helical compression spring
50 Extension
52 Tappet
58 O-ring
60 Working Space
62 Lateral outlet opening
68 Pressure regulating valve

The invention claimed is:

1. An insert for a container which can be filled with fluid and can be sealed in a pressure-tight manner and from which fluid can be discharged, said insert comprising:

a housing comprising a chamber for receiving a $CO_2$ high-pressure cartridge;

a circumferential collar formed on said housing and comprising a seal for sealing said insert in an opening in the container;

a pressure-regulating valve for dispensing $CO_2$ from said high-pressure cartridge into the container;

said pressure-regulating valve comprising:

a valve member mounted together with an elastic diaphragm within said housing;

a tap needle combined with said valve member for piercing said $CO_2$ high-pressure cartridge;

a valve seat arranged within said housing and cooperating with said valve member;

a slide member arranged within said housing axially guided and biased by a spring against said valve member and said tap needle;

a working space bound by said diaphragm downstream from said valve seat;

a lateral outlet opening arranged within said working space for dispensing pressure therefrom; and an O-ring disposed in front of said lateral outlet opening acting as a non-return valve.

2. The insert of claim 1, further comprising:

a control knob accessible from the outside of the container and being held rotatably within said housing by threads guided within said housing, whereby said control knob can be turned forward against said slide member for actuating said $CO_2$ high-pressure cartridge by piercing with said tap needle.

3. The insert of claim 2, wherein:

when said control knob is actuated for the first time, after exceeding a predetermined angle of rotation for tapping said $CO_2$ high-pressure cartridge, said slide member is configured to spring back axially against said control knob, snap into place and lock said control knob against further actuation.

4. The insert of claim 3, wherein:

said tap needle is structurally combined with said valve member, which is arranged axially displaceably against said valve seat between a sealing position and an open position, wherein said slide member is configured for springing back actuated from said tap needle.

5. The insert of claim 1, wherein:

when said $CO_2$ high-pressure cartridge is tapped, said slide member comes into flush contact, end face against end face with said tap needle.

6. The insert of claim 1, wherein:

said tap needle cooperates with said valve seat for occupying a sealing position immediately prior to piercing said $CO_2$ high-pressure cartridge.

7. The insert of claim 1, wherein:

said housing comprises a fluid-tightly sealed chamber, wherein said $CO_2$ high-pressure cartridge is received with a snug fit with its head facing towards said tap needle.

8. The insert of claim 7, wherein:

said $CO_2$ high-pressure cartridge comprises a neck of small diameter being sealed against a wall of said chamber.

9. The insert of claim 1, wherein:

said circumferential collar is configured for being inserted into a bunghole of the container through which the container can be filled with fluid.

10. An insert for a container which can be filled with fluid and can be sealed in a pressure-tight manner and from which fluid can be discharged, said insert comprising:

a housing comprising a chamber for receiving a $CO_2$ high-pressure cartridge;

a circumferential collar formed on said housing and comprising a seal for sealing said insert in an opening in said container;

a pressure-regulating valve for dispensing $CO_2$ from said high-pressure cartridge into said container;

said pressure-regulating valve comprising:

a valve member mounted together with an elastic diaphragm within said housing;

a tap needle combined with said valve member for piercing said $CO_2$ high-pressure cartridge;

a valve seat arranged within said housing and cooperating with said valve member;

a slide member arranged within said housing axially guided and biased by a spring against said valve member and said tap needle; and a control knob accessible from the outside of the container and being held rotatably within said housing by threads guided within said housing, whereby said control knob can be turned forward against said slide member for actuating said $CO_2$ high-pressure cartridge by piercing with said tap needle;

wherein said tap needle cooperates with said valve seat for occupying a sealing position immediately prior to piercing said $CO_2$ high-pressure cartridge.

11. The insert of claim 10, wherein:

said housing comprises a fluid-tightly sealed chamber, wherein said $CO_2$ high-pressure cartridge is received with a snug fit with its head facing towards said tap needle.

12. The insert of claim 11, wherein:

said $CO_2$ high-pressure cartridge comprises a neck of small diameter being sealed against a wall of said chamber.

13. The insert of claim 10, wherein:

said circumferential collar is configured for being inserted into a bunghole of the container through which the container can be filled with fluid.

14. An insert for a container which can be filled with fluid and can be sealed in a pressure-tight manner and from which fluid can be discharged, said insert comprising:

a housing comprising a chamber for receiving a $CO_2$ high-pressure cartridge;

a circumferential collar formed on said housing and comprising a seal for sealing said insert in an opening in said container;

a pressure-regulating valve for dispensing $CO_2$ from said high-pressure cartridge into said container;

said pressure-regulating valve comprising:

a valve member mounted together with an elastic diaphragm within said housing;

a tap needle combined with said valve member for piercing said $CO_2$ high-pressure cartridge;

a valve seat arranged within said housing and cooperating with said valve member; and a slide member arranged within said housing axially guided and biased by a spring against said valve member and said tap needle;

wherein said tap needle cooperates with said valve seat for occupying a sealing position immediately prior to piercing said $CO_2$ high-pressure cartridge.

15. The insert of claim 14, wherein:

said housing comprises a fluid-tightly sealed chamber, wherein said $CO_2$ high-pressure cartridge is received with a snug fit with its head facing towards said tap needle.

16. The insert of claim 15, wherein:

said $CO_2$ high-pressure cartridge comprises a neck of small diameter being sealed against a wall of said chamber.

17. The insert of claim 14, wherein:

said circumferential collar is configured for being inserted into a bunghole of the container through which the container can be filled with fluid.

* * * * *